US006266851B1

(12) United States Patent
Lu

(10) Patent No.: US 6,266,851 B1
(45) Date of Patent: Jul. 31, 2001

(54) PAPER CLIPPING DEVICE

(76) Inventor: Haur-Wen Lu, 12F-6, 75 Hsin Tai Wu Rd. Sec. 1, Hsichih, Taipei (TW)

( * ) Notice: Subject to any disclaimer, the term of this patent is extended or adjusted under 35 U.S.C. 154(b) by 0 days.

(21) Appl. No.: 09/533,790

(22) Filed: Mar. 24, 2000

(51) Int. Cl.[7] ..... A44B 21/00; A45D 8/24
(52) U.S. Cl. ..... 24/3.12; 24/511; D8/395
(58) Field of Search ..... 24/3.11, 3.12, 24/334, 327, 343, 494, 496, 497, 499, 500, 502, 508, 509–511, DIG. 8, DIG. 22, 67.3, 67.5, 67.7; D3/395; D19/65, 86, 88, 99

(56) References Cited

U.S. PATENT DOCUMENTS

D. 383,666 * 9/1997 Adams ..... D8/396
D. 396,184 * 7/1998 Adams et al. ..... D8/395
D. 421,565 * 3/2000 Jones et al. ..... D8/395
3,756,550 * 9/1973 Kollitz ..... 24/511 X
4,407,285 * 10/1983 Perlin ..... 24/500 X
4,934,304 * 6/1990 Rosen ..... 24/303 X

* cited by examiner

*Primary Examiner*—Robert J. Sandy
(74) *Attorney, Agent, or Firm*—Dougherty & Troxell

(57) ABSTRACT

Paper clipping device including a casing and a trigger member. The casing is designed with a configuration of an animal and formed with an internal chamber in which the trigger member is disposed. One end of the trigger member is formed with a tail-like press bar section rearward extending out of the casing and the other end of the trigger member is formed with a toothed section protruding from a mouth section of the casing. A spring is installed between the wall of the chamber and the trigger member, whereby in a natural state, the trigger member is forcedly positioned on one side wall of the chamber to bite and clip a paper. When a user presses the press bar section of the trigger member, the spring is compressed and the toothed section is deflected to release the paper. The paper clipping device can be rested on a plane face to achieve a decorative effect.

12 Claims, 3 Drawing Sheets

PAPER CLIPPING DEVICE

BACKGROUND OF THE INVENTION

The present invention relates to a paper clipping device which is used to clip or fix a memo, a receipt, a name card or the like.

Some of the conventional paper clips employ a magnet to clamp papers by attraction. Alternatively, some of the conventional paper clips are iron-made. The iron clip is made of a panel which is symmetrically bent and formed with two wall sections. Two free ends of the wall sections normally contact with each other. Two lever rods are mounted on the wall sections. The lever rods are compressible to forcedly separate the wall sections from each other for clipping the paper.

When clipping the paper, the wall sections of the iron clip define a clearance therebetween for receiving a front part of the paper. Such iron clip generally has no magnetic attraction.

The above conventional paper clipping devices both can hardly rested on a plane face and directly used. Also, the above conventional paper clipping devices lack decorative effect.

SUMMARY OF THE INVENTION

It is therefore a primary object of the present invention to provide a paper clipping device including a casing and a trigger member. The casing is designed with a configuration of an animal and formed with an internal chamber in which the trigger member is pivotally disposed via a pin member. One end of the trigger member is formed with a press bar section rearward extending out of the casing and the other end of the trigger member is formed with a toothed section protruding from a mouth section of the casing. A spring is installed between the wall of the chamber and the trigger member, whereby in a natural state, the trigger member is forcedly positioned on one side wall of the chamber to bite and clip a paper. When a user presses the press bar section of the trigger member, the spring is compressed and the toothed section is deflected to release the paper. The paper clipping device can be rested on a plane face to achieve a decorative effect.

The present invention can be best understood through the following description and accompanying drawings wherein:

DETAILED DESCRIPTION OF THE PREFERRED EMBODIMENTS

Figure 1:
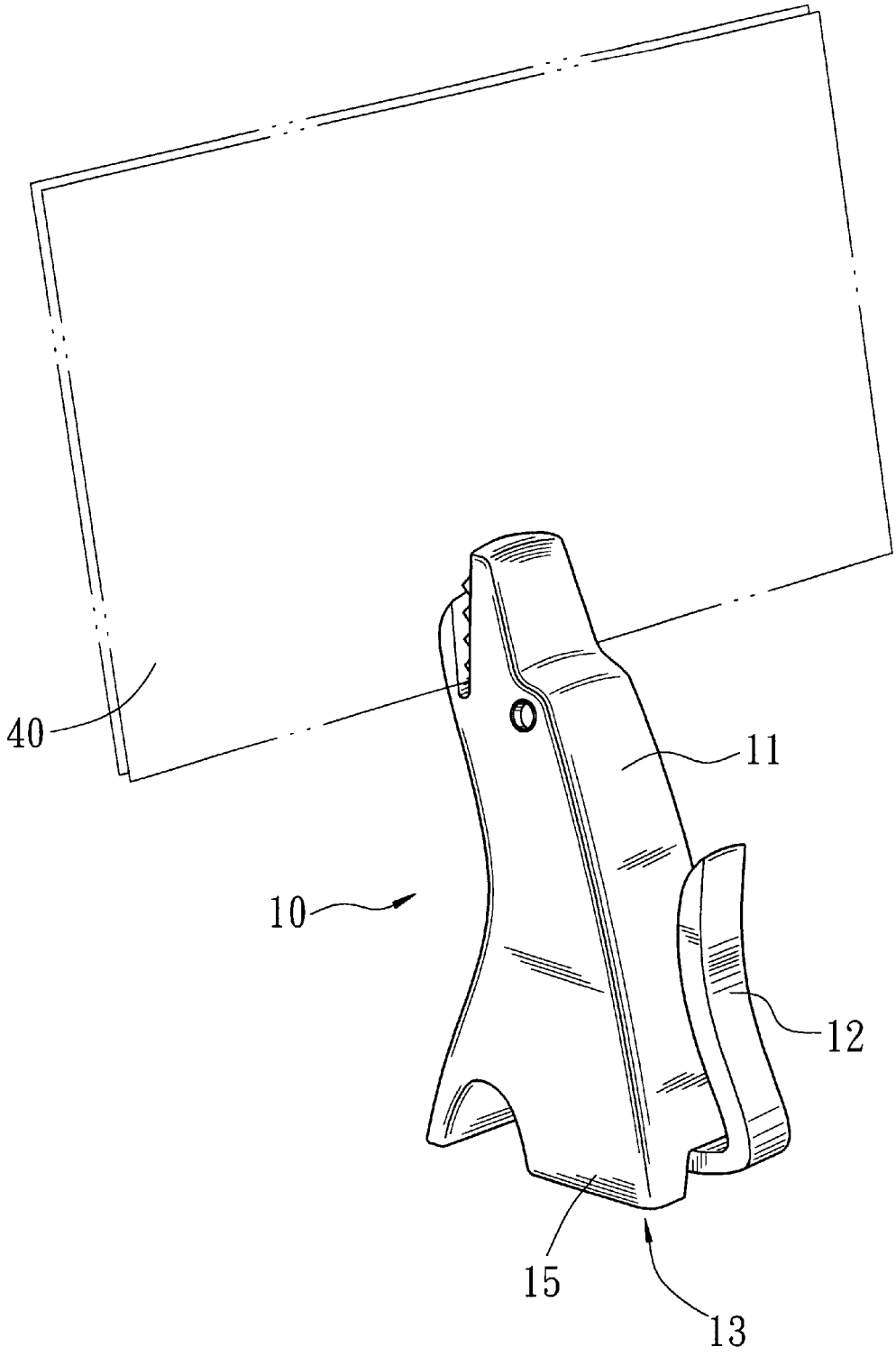
FIG. 1 is a perspective assembled view of the paper clipping device of the present invention.
Figure 2:
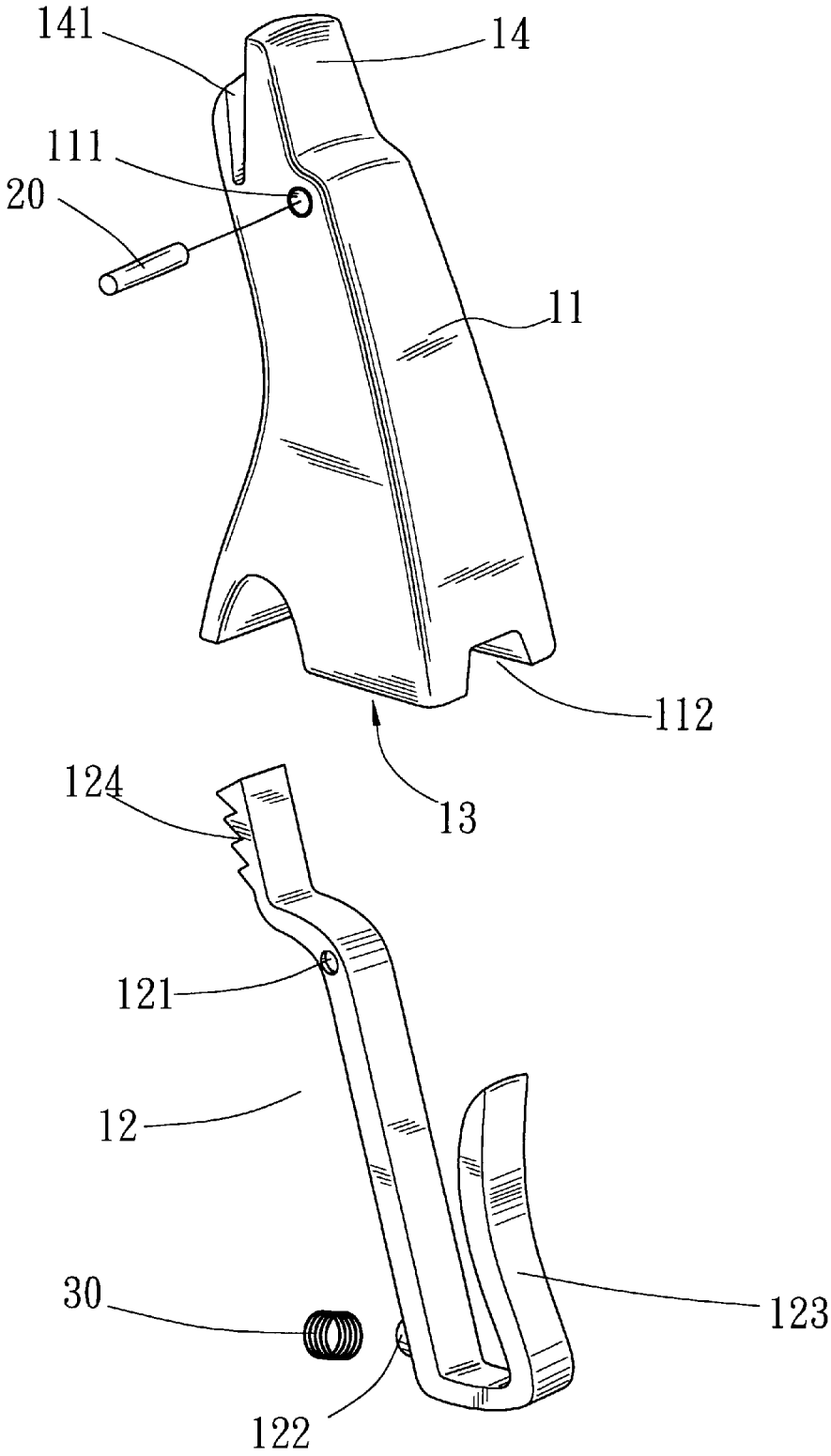
FIG. 2 is a perspective exploded view of the paper clipping device of tie present invention.
Figure 3:
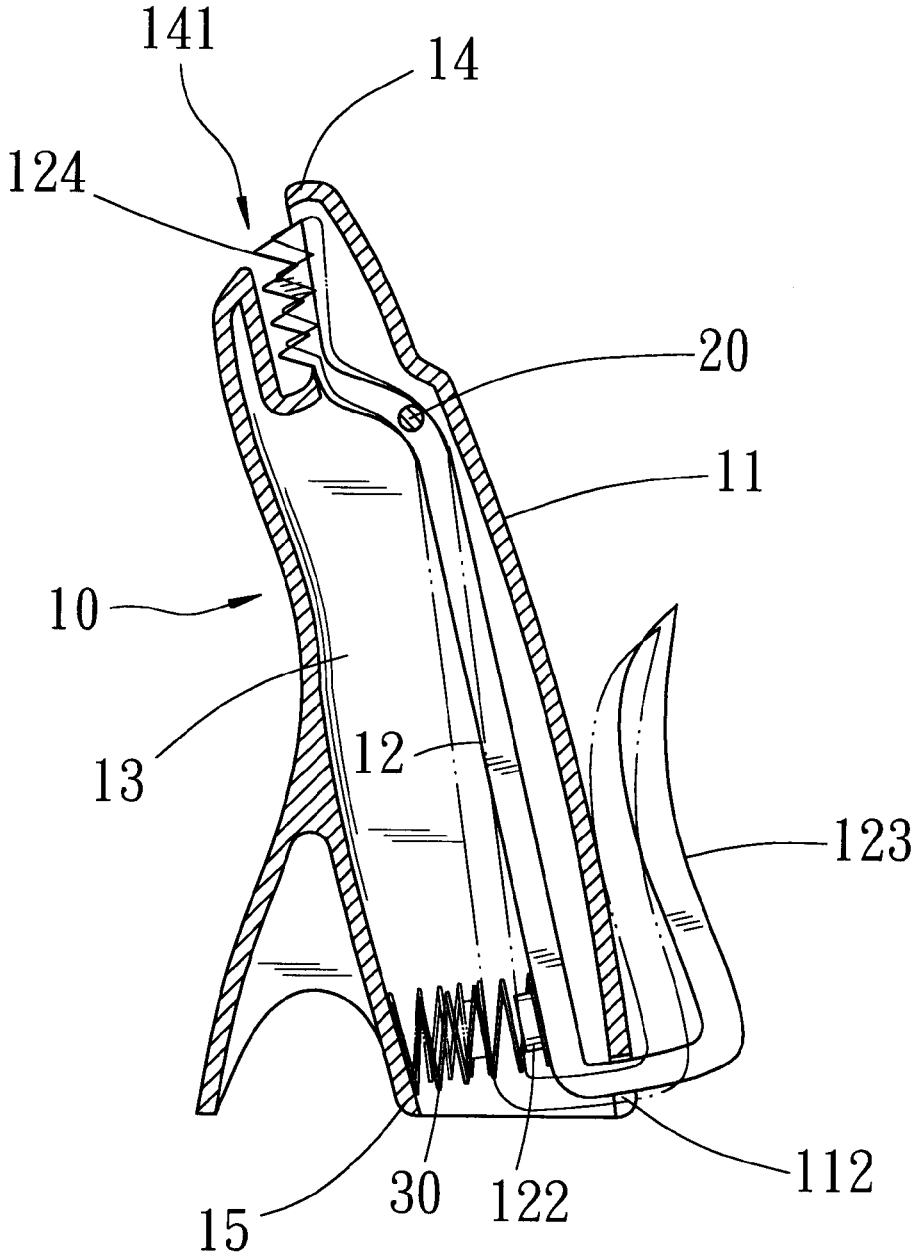
FIG. 3 is a sectional view of the paper clipping device of the present invention, showing the operation of the trigger member in the chamber.

Please refer to FIGS. 1 to 3. The paper clipping device 10 of the present invention includes a casing 11 and a trigger member 12. In a preferred embodiment, the casing 11 is designed with a configuration of an animal such as a dog. The casing 11 is formed with an internal chamber 13 in which the trigger member 12 is disposed.

The casing 11 has a mouth section 14 formed with a notch 141 having a predetermined width for receiving memos, receipts, etc. 40. The bottom section 15 of the casing 11 is formed with an opening 112 for the trigger member 12 to fit into the chamber 13. In this embodiment, the trigger member 12 is an elongated rectangular lever or a geometrical aluminum extrusion. The middle section of the trigger member 12 is formed with a perforation 121 corresponding to a through hole 111 of the casing 11. A pin member 20 is passed through the perforation 121 and the through hole 111 to pivotally connect the trigger member 12 with the casing 11. The trigger member 12 is fitted in the chamber 13 with its end section transversely displaceable. One end of the trigger member 12 is disposed with a lateral projecting boss 122. A spring 30 is installed between the boss 122 and the wall of the chamber 13, whereby in a natural state, the trigger member 12 is forcedly positioned on one side wall of the chamber 13 to bite and clip a paper (as shown by solid line of FIG. 3). In a preferred embodiment, a tail-like and hook-shaped press bar section 123 rearward and upward extends from the position of the boss 122. An opposite face of the other end of the trigger member 12 is formed with a toothed section 124. When the trigger member 12 is fitted in the chamber 13, the press bar section 123 extends out of the opening 112 of the bottom end of the casing 11. At this time, the toothed section 124 protrudes from the notch 141 of the mouth section 14 of the casing 11 as shown by solid line of FIG. 1 or FIG. 2.

Referring to FIG. 3, when a user presses the press bar section 123 of the trigger member 12, the springs 30 is compressed and the toothed section 124 is deflected rightward as shown by the phantom line to release the paper 40.

The above paper clipping device 10 of the present invention can be rested on a plane face to achieve a decorative effect.

The above embodiment is only used to illustrate the present invention, not intended to limit the scope thereof. Many modifications of the above embodiment can be made without departing from the spirit of the present invention.

What is claimed is:

1. A paper clipping device comprising:

a) a casing having an external configuration in the shape of an animal, an internal chamber, and a mouth section with a notch opening to an exterior of the casing in communication with the internal chamber;

b) a trigger member pivotally connected to the casing within the internal chamber between first and second opposite ends of the trigger member, the first end having a toothed section and located within the internal chamber adjacent to the notch, the second end extending exteriorly of the casing; and, c) a biasing member acting on the trigger member to bias the trigger member toward a gripping position wherein the toothed section extends into the notch of the mouth section so as to grip a paper inserted into the notch between the mouth section and the toothed section.

2. The paper clipping device as claimed in claim 1, wherein a bottom section of the casing has an opening through which the second end of the trigger member extends out of the casing.

3. The paper clipping device as claimed in claim 2, wherein the second end of the trigger member comprises a press bar section.

4. The paper clipping device as claimed in claim 2, wherein the casing has an external configuration of a dog.

5. The paper clipping device as claimed in claim 1, wherein the trigger member has a lateral projecting boss on which the biasing member is located.

6. The paper clipping device as claimed in claim 5, wherein the second end of the trigger member comprises a press bar section.

7. The paper clipping device as claimed in claim 5, wherein the casing has an external configuration of a dog.

8. The paper clipping device as claimed in claim 1, wherein a middle section of the trigger member has a perforation corresponding to a through hole in the casing, whereby a pin member is passed through the perforation and the through hole to pivotally connect the trigger member with the casing.

9. The paper clipping device as claimed in claim 8, wherein the second end of the trigger member comprises a press bar section.

10. The paper clipping device as claimed in claim 8, wherein the casing has an external configuration of a dog.

11. The paper clipping device as claimed in claim 1, wherein the second end of the trigger member comprises a press bar section.

12. The paper clipping device as claimed in claim 1, wherein the casing has an external configuration of a dog.

* * * * *